US007267526B2

(12) United States Patent
Hsu et al.

(10) Patent No.: US 7,267,526 B2
(45) Date of Patent: Sep. 11, 2007

(54) HEAT-DISSIPATING DEVICE

(75) Inventors: Wei-Chun Hsu, Taoyuan (TW); Shun-Chen Chang, Taoyuan (TW); Wen-Shi Huang, Taoyuan Hsien (TW)

(73) Assignee: Delta Electronics Inc., Taoyuan Hsien (TW)

( * ) Notice: Subject to any disclaimer, the term of this patent is extended or adjusted under 35 U.S.C. 154(b) by 235 days.

(21) Appl. No.: 11/058,632

(22) Filed: Feb. 16, 2005

(65) Prior Publication Data

US 2005/0260069 A1 Nov. 24, 2005

Related U.S. Application Data

(63) Continuation-in-part of application No. 10/848,074, filed on May 19, 2004.

(30) Foreign Application Priority Data

Jul. 16, 2004 (TW) ..... 93121278 A

(51) Int. Cl.
*F01D 5/14* (2006.01)

(52) U.S. Cl. ..... 415/184; 416/198

(58) Field of Classification Search ..... 415/199.6, 415/184, 204, 206, 211.2; 416/189, 198 R
See application file for complete search history.

(56) References Cited

U.S. PATENT DOCUMENTS 3,365,892 A * 1/1968 Derderian ..... 415/199.6
5,025,629 A * 6/1991 Woollenweber ..... 415/160
6,386,839 B1 * 5/2002 Chuang ..... 415/199.6

* cited by examiner

*Primary Examiner*—Igor Kershteyn
(74) *Attorney, Agent, or Firm*—Birch, Stewart, Kolasch & Birch, LLP

(57) ABSTRACT

A heat-dissipating device includes a housing having an air inlet and an air outlet, and a blade structure disposed in the housing and having a hub and a plurality of rotor blades. The housing has an inwardly extending sidewall to define an accelerating airflow passage between the sidewall, the hub and the rotor blades for effectively increasing the airflow pressure and stabilizing the discharged airflow.

19 Claims, 6 Drawing Sheets

HEAT-DISSIPATING DEVICE

FIELD OF THE INVENTION

The present invention is a continuation-in-part application of the parent application bearing Ser. No. 10/848,074 and filed on May 19, 2004. The present invention relates to a heat-dissipating device, and in particular to a centrifugal fan with an accelerating airflow passage for increasing airflow pressure and stabilizing the discharged airflow.

DESCRIPTION OF THE RELATED ART

In FIGS. 1A~1C, a conventional blower 1 includes a frame 10, a motor 11, an impeller 12 and a cover 13. The frame 10 includes an opening 101 as an air outlet and the cover 13 has a circular opening 131 as an air inlet. The way from the air inlet to the air outlet constitutes an airflow passage. The motor 11 is disposed on a base 101 of the frame 10 to drive the impeller 12. The impeller 12 includes a hub 121, an annular plate 122 and a plurality of blades 123 disposed on the upper side and the lower side of the annular plate 122 and circumferentially disposed around the hub 121.

However, the blades 123 are located in the airflow passage and the airflow must be turned to the blades by 90° angle after entering into the air inlet as indicated by an imaginary arrow in FIG. 1C. Further, the accelerating direction in the airflow passage is different from the intake direction of airflow, and the longer the accelerating distance from the air inlet to the bottom of the frame, the slower the flow rate, thereby causing uneven flow rate on the air outlet and decreasing heat-dissipating efficiency thereof.

Moreover, because the air directly flows toward the blades, the flow rate is suddenly increased to induce a high load of the blades and decrease the rotation speed, resulting in a limitation of the heat-dissipating performance.

SUMMARY OF THE INVENTION

According to the present invention, the heat-dissipating device includes a housing having an air inlet and an air outlet, and a blade structure disposed in the housing and having a hub and a plurality of rotor blades wherein the housing has an inwardly extending sidewall to define an accelerating airflow passage between the sidewall, the hub and the rotor blades.

Preferably, the accelerating airflow passage is a perpendicular passage relative to a bottom surface of the housing, or a partially outwardly bent passage with respect to an axis of the heat-dissipating device.

The airflow direction in the accelerating airflow passage is substantially perpendicular to top edges of the rotor blades. The blade structure further includes a base coupled to the hub for allowing the rotor blades to be disposed thereon and the top edges of the rotor blades are relatively lower than a top surface of the hub. Preferably, the hub, the base and the rotor blades are integrally formed as a monolithic piece by injection molding.

In addition, the housing further includes a first frame provided with a base to support the blade structure, and a second frame coupled to the first frame and provided with the air inlet, wherein the sidewall extends from a periphery of the air inlet toward the first frame to define an air-gathering chamber in the housing.

The sidewall has a flange at one end thereof extending outwardly to define an entrance of the air-gathering chamber, wherein a portion of each rotor blades extends radially toward the entrance of the air-gathering chamber for guiding the airflow into the air-gathering chamber.

Preferably, the air-gathering chamber partially or completely overlaps an air passage through the blade structure in height along an axis of the heat-dissipating device.

Preferably, a cross-sectional area of the air-gathering chamber is substantially equal to that of the air outlet of the housing.

Moreover, the second frame has an extending part formed in an inner surface thereof and extending toward the first frame to form a single-side axially compressed airflow passage in the housing. Preferably, the extending part of the second frame has an axially extending depth gradually increased from a position proximal to the air outlet to that distal to the air outlet.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS present application will become more fully understood from the subsequent detailed description and the accompanying drawings, which are given by way of illustration only, and thus are not limitative of the present invention, and wherein.

DETAILED DESCRIPTION OF THE INVENTION

Figure 2A:
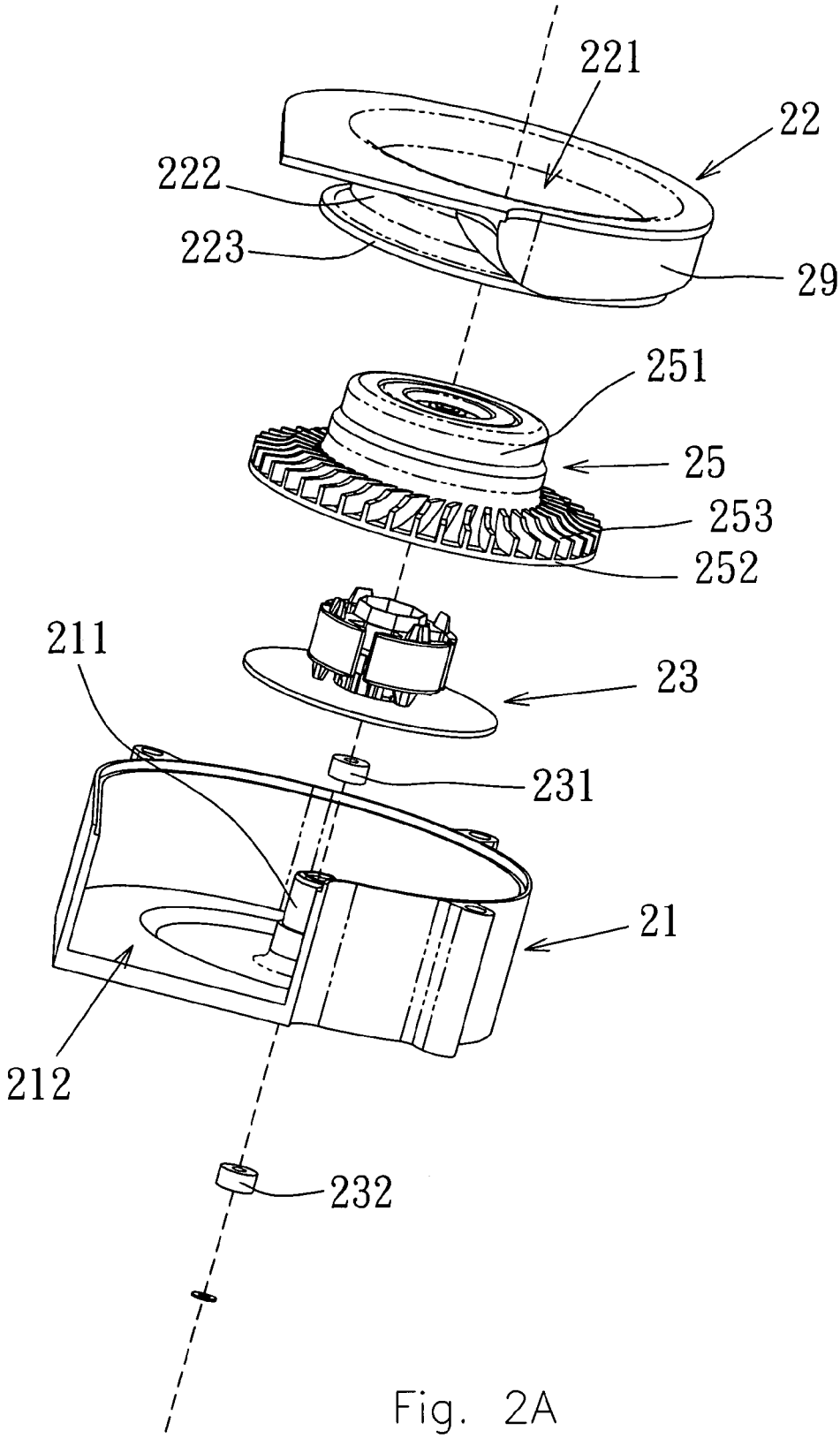
FIG. 2A is an exploded view of a heat-dissipating device according to an embodiment of the present invention.
Figure 2B:
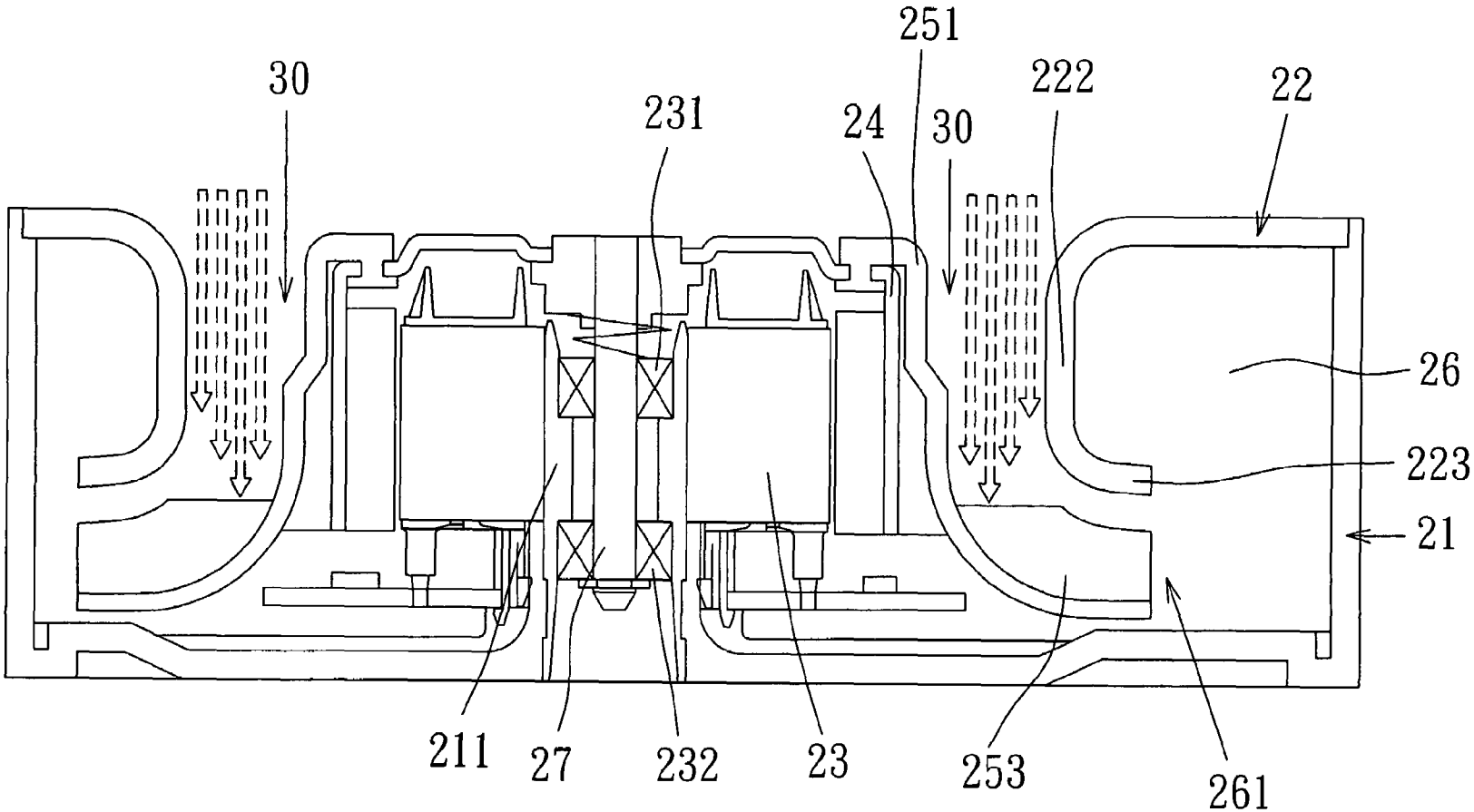
FIG. 2B is a sectional view of the heat-dissipating device of FIG. 2A after being assembled.

Please refer to FIGS. 2A and 2B showing an embodiment of the invention. The heat-dissipating device is exemplified by a centrifugal fan, which is a single-suction blower. It includes a housing constituted by a first frame 21 and a second frame 22, a driving device 23, a metallic shell 24 and a blade structure 25.

The first frame 21 includes a base with a bearing tube 211 for receiving and supporting the driving device 23 and the bearings 231, 232 are mounted inside the bearing tube 211 for supporting a rotating shaft 27 of the blade structure 25. The second frame 22 includes an air inlet 221 and a sidewall 222 extending downward from an inner margin of the air inlet 221. When the first frame 21 and the second frame 22 are assembled together, a space will be formed inside the heat-dissipating device and can be divided to an air-gathering chamber 26 and a partition for disposing the blade structure 25 therein by the sidewall 222. An air outlet 212 is also formed simultaneously. A flange 223 is radially extending from the bottom of the sidewall 222 to define an entrance 261 of the air-gathering chamber 26.

The blade structure 25 includes a hub 251, a base 252 radially extending from the bottom end of the hub 251, and one set of rotor blades 253, and driven by the driving device 23 coupled inside the hub 251. The set of rotor blades 253 is constituted by a plurality of curved blades disposed on the base 252 and each blade has one end extending toward the entrance 261 of the air-gathering chamber 26, wherein the top edge of each blade is positioned lower than the top surface of the hub. Certainly, the size, shape, and disposition of the rotor blades include but not limited to those shown in FIG. 2A. The hub 251, a base 252 and the rotor blades 253 can be integrally formed as a monolithic piece by injection molding.

As shown in FIG. 2B, there is an accelerating airflow passage 30 formed between the hub 251, the sidewall 222 of the second frame 22, the rotor blades 253 and the air inlet 221. The airflow direction in the accelerating airflow passage 30 is substantially perpendicular to the top edge of the rotor blade. In other words, the top edge of the rotor blade is substantially perpendicular to the sidewall 222. Therefore, when the blade structure is rotating, the air will axially flow toward the top edge of the rotor blade through the accelerating airflow passage 30. Because the accelerating direction of airflow is the same as that of entering toward the top edge of the rotor blade, the air pressure can be effectively increased so as to enhance the heat-dissipating efficiency of the fan. In addition, the accelerating airflow passage 30 can also be designed to be partially outwardly bent with respect to an axis of the heat-dissipating device.

As the blade structure 25 rotates, the airflow is intaked into the air inlet 221 and passes through the rotor blades 253, and is guided into the air-gathering chamber 26. In the air-gathering chamber 26, the airflow is gradually collected and discharged therefrom to the exterior at a high pressure via the air outlet 221. Thus, the airflow sequentially passes through the air inlet 221, the rotor blades 253 and the entrance 261 of the air-gathering chamber 26.

Because the sidewall 222 extends downward from the inner margin of the air inlet 221 and separates the air-gathering chamber 26 from the blade structure 25 and the size of the air outlet 212 is reduced, time of airflow pressurization by the blade structure 25 is increased such that the variation in airflow pressure are stabilized. Further, because the height of the air-gathering chamber 26 partially or completely overlaps that of the accelerating airflow passage and the blade structure 25, the centrifugal fan can be minimized. The cross-sectional area of the air-gathering chamber 26 is substantially equal in size to that of the air outlet 212 such that airflow can constantly and stably moves within the air-gathering chamber 26 and the air outlet 212 to prevent work loss.

On the other hand, the centrifugal fan of the present invention has an axially compressed airflow passage formed inside its housing. FIG. 2A shows a single-side axially compressed airflow passage. The inner surface of the second frame 22 has an extending part 29 extending toward the first frame 21. Its axially extending depth is gradually increased from the position proximal to the air outlet to that distal to the air outlet. As the first frame 21 and the second frame 22 are combined together, the axially compressed airflow passage is formed inside its housing to enable the airflow to flow more smoothly. Of course, in another aspect of the present invention, the extending part can be formed on the inner surface of the first frame, or both on the inner surfaces of the first and second frames to define a two-side axially compressed airflow passage except having the radially compressed airflow passage 14 like the conventional blower.

Figure 1A:
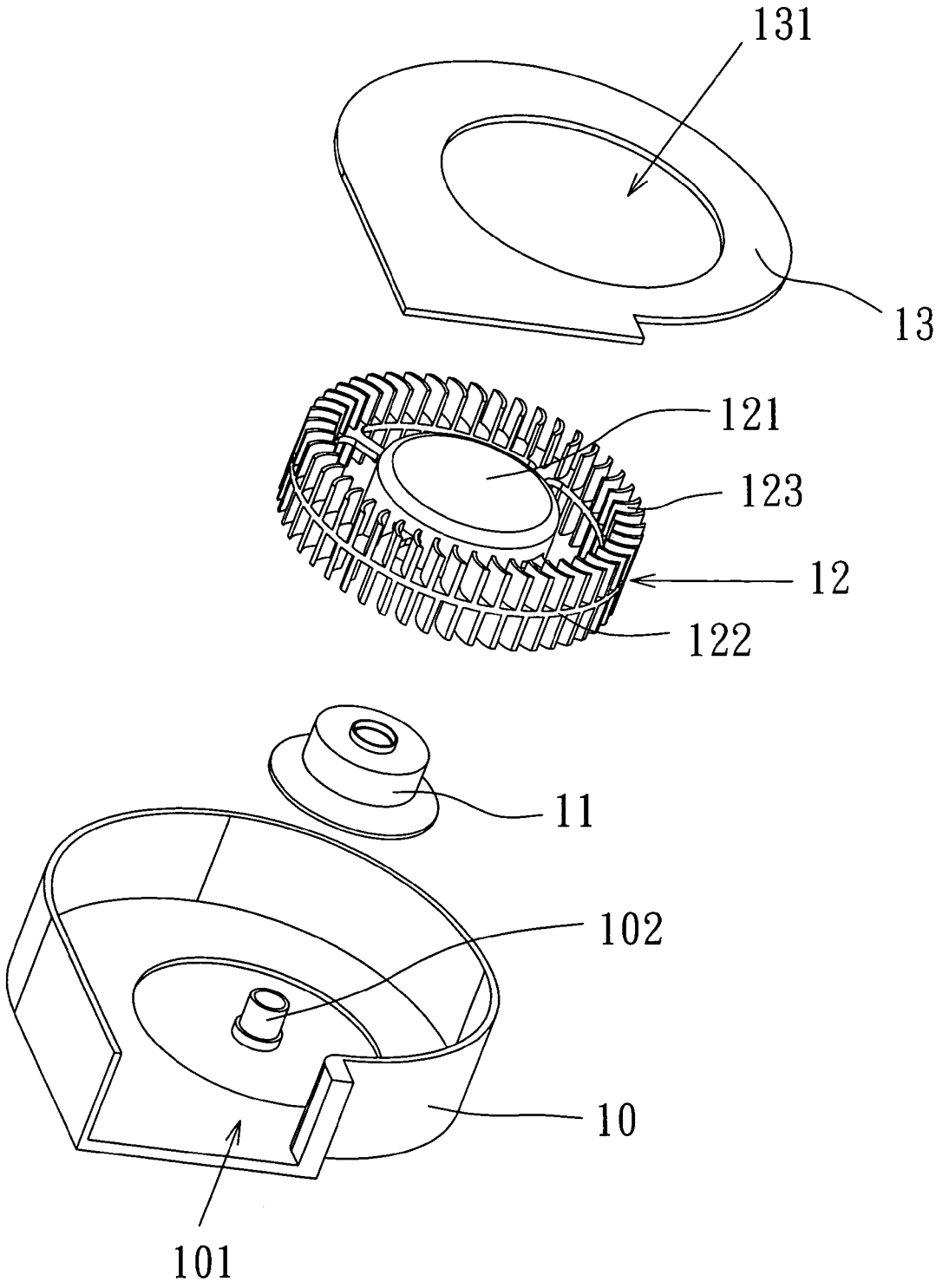
Fig. 1A (PRIOR ART)
FIG. 1A is an exploded view of a conventional blower.
Figure 1B:
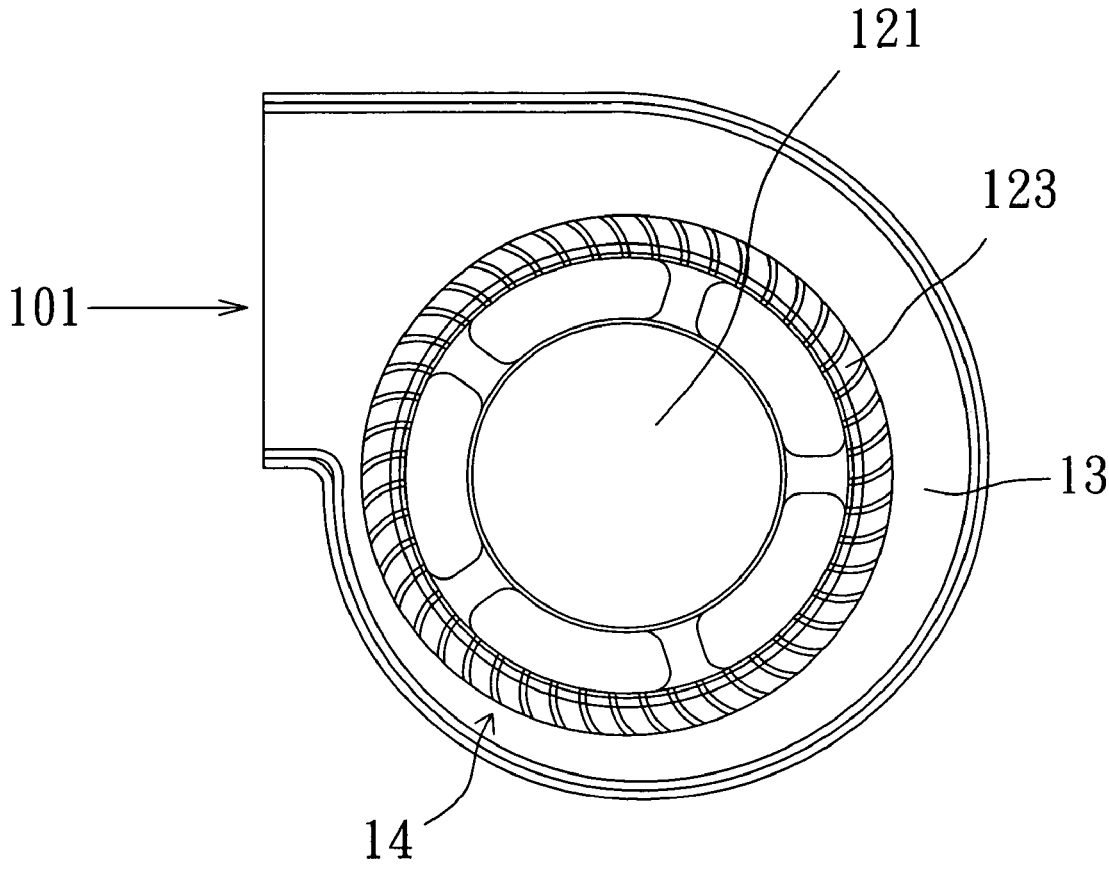
Fig. 1B (PRIOR ART)
FIG. 1B is a top view of the conventional blower shown in FIG. 1A after being assembled.
Figure 1C:
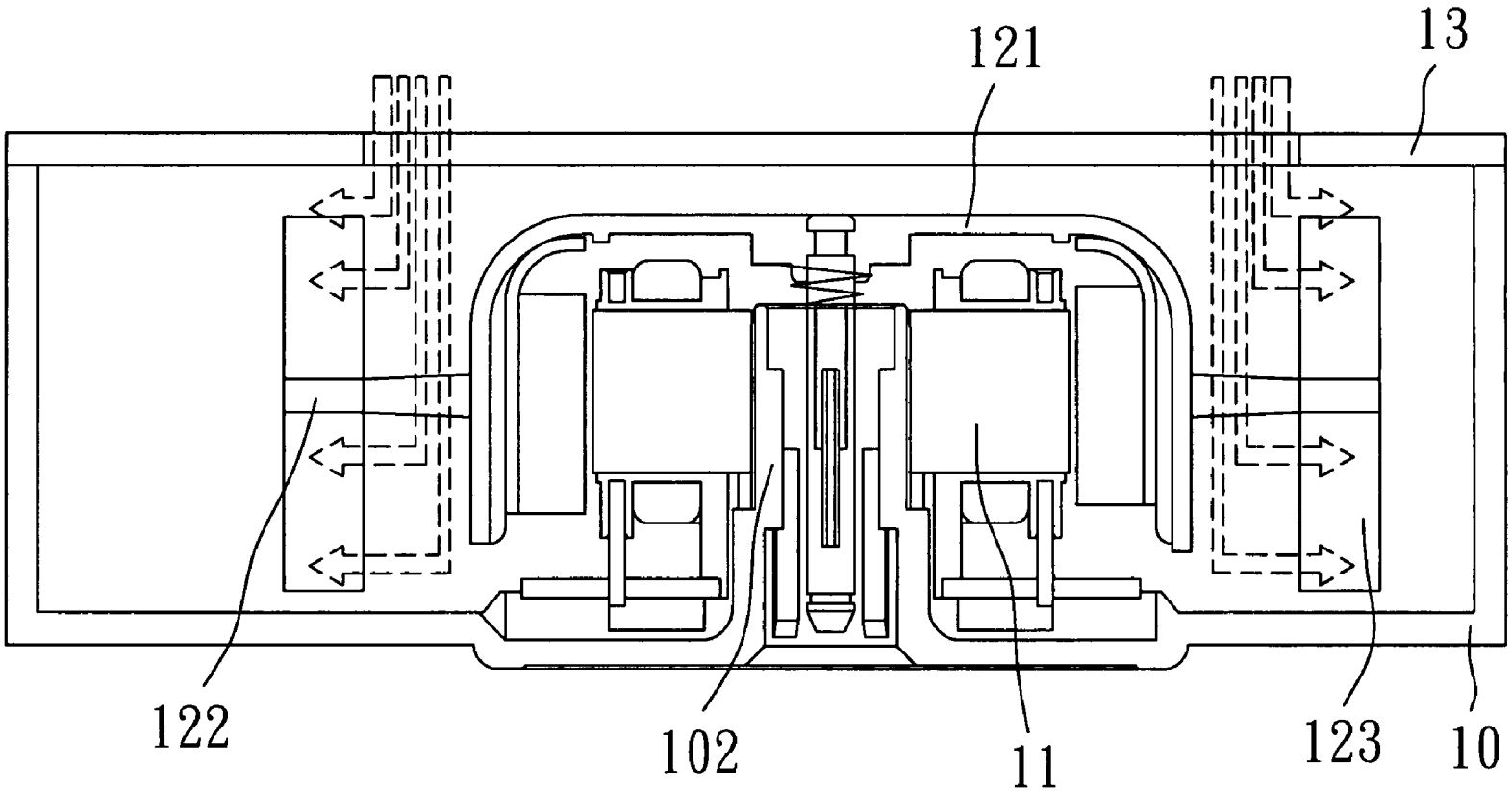
Fig. 1C (PRIOR ART)
FIG. 1C is a sectional view of the conventional blower shown in FIG. 1A after being assembled.
Figure 3:
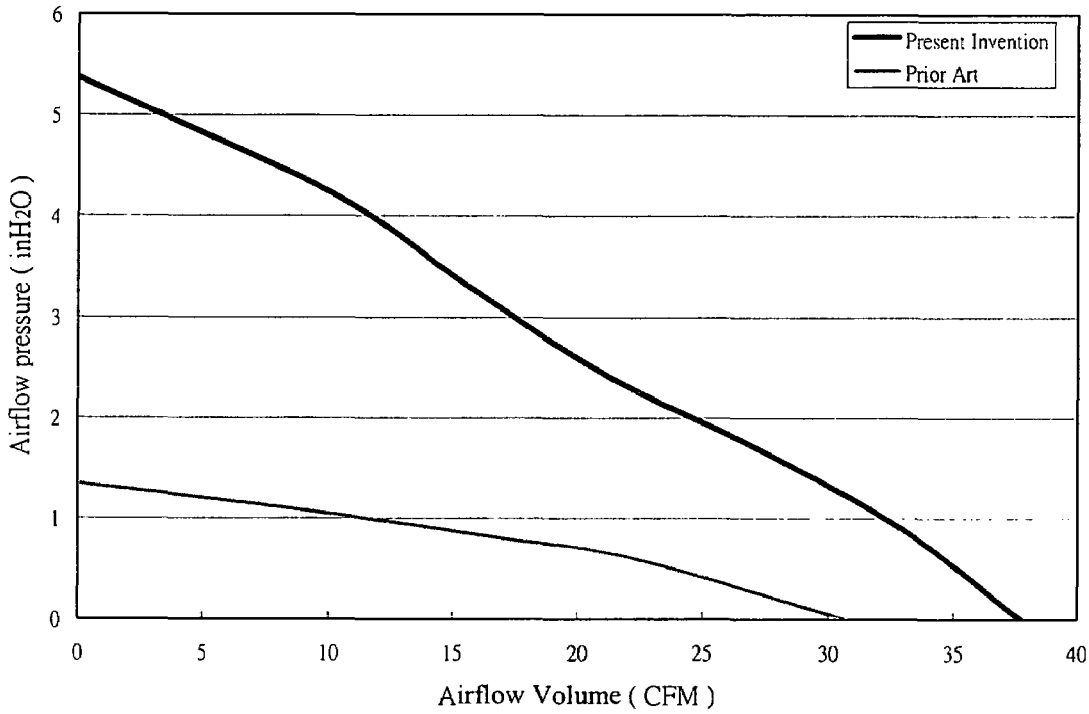
FIG. 3 shows the airflow volume and airflow pressure comparison between the conventional blower of FIG. 1 and the heat-dissipating device of the present invention.

Finally, please refer to FIG. 3 which shows the comparison of the airflow pressure and airflow volume of the centrifugal fan of the invention shown in FIGS. 2A~2B between those of the conventional blower of FIGS. 1A~1C. This figure can demonstrate that the airflow pressure and volume of the centrifugal fan of the invention can be greatly increased by the accelerating airflow passage.

According to the above description, the present invention provides a heat-dissipating device with an accelerating airflow passage to provide even airflow rate in the airflow passage and effectively increase air pressure, thereby enhancing its performance and heat-dissipating efficiency.

While the invention has been described in connection with what is presently considered to be the most practical and preferred embodiment, it is to be understood that the invention is not limited to the disclosed embodiments, but, on the contrary, is intended to accommodate various modifications and equivalent arrangements included within the spirit and scope of the appended claims.

What is claimed is:

1. A heat-dissipating device, comprising:

a housing having an air inlet and an air outlet; and a blade structure disposed in the housing and having a hub and a plurality of rotor blades wherein the housing has an inwardly extending sidewall to define an accelerating airflow passage between the sidewall, the hub and the rotor blades, and an air-gathering chamber between the side wall and a peripheral wall of the housing.

2. The heat-dissipating device of claim 1, wherein the accelerating airflow passage is a perpendicular passage relative to a bottom surface of the housing, or a partially outwardly bent passage with respect to an axis of the heat-dissipating device.

3. The heat-dissipating device of claim 1, wherein an airflow direction in the accelerating airflow passage is substantially perpendicular to top edges of the rotor blades.

4. The heat-dissipating device of claim 3, wherein the blade structure further comprises a base coupled to the hub for allowing the rotor blades to be disposed thereon and the top edges of the rotor blades are relatively lower than a top surface of the hub.

5. The heat-dissipating device of claim 4, wherein the hub, the base and the rotor blades are integrally formed as a monolithic piece by injection molding.

6. The heat-dissipating device of claim 1, wherein the housing further comprises:

a first frame provided with a base to support the blade structure; and a second frame coupled to the first frame and provided with the air inlet, wherein the sidewall extends from a periphery of the air inlet toward the first frame to define the air-gathering chamber in the housing.

7. The heat-dissipating device of claim 6, wherein the sidewall has a flange at one end thereof extending outwardly to define an entrance of the air-gathering chamber.

8. The heat-dissipating device of claim 6, wherein a portion of each rotor blades extends radially toward the entrance of the air-gathering chamber for guiding the airflow into the air-gathering chamber.

9. The heat-dissipating device of claim 6, wherein the air-gathering chamber partially or completely overlaps an air passage through the blade structure in height along an axis of the heat-dissipating device.

10. The heat-dissipating device of claim 6, wherein a cross-sectional area of die air-gathering chamber is substantially equal to that of the air outlet of the housing.

11. The heat-dissipating device of claim 6, wherein the second frame has an extending part formed in an inner surface thereof and extending toward the first frame to form a single-side axially compressed airflow passage in the housing.

12. The heat-dissipating device of claim 11, wherein the extending part of the second frame has an axially extending depth gradually increased from a position proximal to the air outlet to that distal to the air outlet.

13. A heat-dissipating device, comprising:

a housing having a first frame with an air outlet and a second frame with an air inlet; and a blade structure disposed in the housing and having a hub and a plurality of rotor blades wherein the second frame has a sidewall extending toward the first frame to define an accelerating airflow passage between the sidewall, the hub and the rotor blades, and an air-gathering chamber between the side wall and a peripheral wall of the housing.

14. The heat-dissipating device of claim 13, wherein the accelerating airflow passage is a perpendicular passage relative to a bottom surface of the housing, or a partially outwardly bent passage with respect to an axis of the heat-dissipating device.

15. The heat-dissipating device of claim 13, wherein an airflow direction in the accelerating airflow passage is substantially perpendicular to top edges of the rotor blades.

16. The heat-dissipating device of claim 15, wherein the blade structure further comprises a base coupled to the hub for allowing the rotor blades to be disposed thereon and the top edges of the rotor blades are relatively lower than a top surface of the hub.

17. The beat-dissipating device of claim 16, wherein the hub, the base and the rotor blades are integrally formed as a monolithic piece by injection molding.

18. The heat-dissipating device of claim 13, wherein the sidewall extends from a periphery of the air inlet toward the first frame to define the air-gathering chamber in the housing.

19. The heat-dissipating device of claim 18, wherein the sidewall has a flange at one end thereof extending outwardly to define an entrance of the air-gathering chamber and a portion of each rotor blades extends radially toward the entrance of the air-gathering chamber for guiding the airflow into the air-gathering chamber.

* * * * *